US011778408B2

(12) United States Patent
Sunder et al.

(10) Patent No.: US 11,778,408 B2
(45) Date of Patent: Oct. 3, 2023

(54) SYSTEM AND METHOD TO VIRTUALLY MIX AND AUDITION AUDIO CONTENT FOR VEHICLES

(71) Applicant: EmbodyVR, Inc., San Mateo, CA (US)

(72) Inventors: Kaushik Sunder, Mountain View, CA (US); Marielle Venita Jakobsons, Oakland, CA (US); Kapil Jain, Redwood City, CA (US)

(73) Assignee: EMBODYVR, INC., San Mateo, CA (US)

( * ) Notice: Subject to any disclaimer, the term of this patent is extended or adjusted under 35 U.S.C. 154(b) by 0 days.

(21) Appl. No.: 17/584,984

(22) Filed: Jan. 26, 2022

(65) Prior Publication Data

US 2022/0240043 A1 Jul. 28, 2022

Related U.S. Application Data

(60) Provisional application No. 63/141,911, filed on Jan. 26, 2021.

(51) Int. Cl.
*H04S 7/00* (2006.01)
*H04R 1/08* (2006.01)
(Continued)

(52) U.S. Cl.
CPC ..... *H04S 7/303* (2013.01); *H04R 1/08* (2013.01); *H04R 1/1041* (2013.01); *H04R 3/12* (2013.01); *H04R 2499/13* (2013.01)

(58) Field of Classification Search
None
See application file for complete search history.

(56) References Cited

U.S. PATENT DOCUMENTS 5,708,725 A 1/1998 Ito
7,664,272 B2 * 2/2010 Terai ..... H04S 1/005 381/1
(Continued)

FOREIGN PATENT DOCUMENTS

JP 3521900 B2 4/2004
KR 20150009384 A 1/2015
WO WO-2017047309 A1 3/2017

OTHER PUBLICATIONS

Abaza, et al., "A Survey on Ear Biometrics", ACM Comput. Surv. 45, 2, Article 22, 2013, 35 pages.
(Continued)

*Primary Examiner* — Paul W Huber

(57) ABSTRACT

A system comprises a sound source to output an audio signal to a plurality of speakers arranged in a plurality of locations in a vehicle. A laser device is disposed on an object representing a human head placed in a seat of the vehicle to scan the locations of the speakers. A microphone is disposed in each ear of the object. A controller routes the audio signal to the speakers one speaker at a time, receives audio signals received via the microphones, and compiles binaural acoustic data for the vehicle based on the audio signals received via the microphones. The controller receives scan data from the laser device and generates geometric data for the vehicle based on the scan data. The controller generates head-related transfer functions (HRTFs) for the object based on the binaural acoustic data and the geometric data for the vehicle.

8 Claims, 8 Drawing Sheets

(51) Int. Cl.
*H04R 1/10* (2006.01)
*H04R 3/12* (2006.01)

(56) References Cited

U.S. PATENT DOCUMENTS

| | | | | |
|---|---|---|---|---|
| 9,030,545 | B2 | 5/2015 | Pedersen | |
| 9,473,858 | B2 | 10/2016 | Pedersen et al. | |
| 9,544,706 | B1 | 1/2017 | Hirst | |
| 9,900,722 | B2 | 2/2018 | Bilinski et al. | |
| 10,181,328 | B2 | 1/2019 | Jensen et al. | |
| 10,200,806 | B2 | 2/2019 | Stein et al. | |
| 10,433,095 | B2 | 10/2019 | Jain | |
| 10,659,908 | B2 | 5/2020 | Jain | |
| 10,972,850 | B2 * | 4/2021 | Norris | H04R 5/033 |
| 2003/0035551 | A1 | 2/2003 | Light et al. | |
| 2004/0136538 | A1 | 7/2004 | Cohen et al. | |
| 2006/0067548 | A1 | 3/2006 | Slaney et al. | |
| 2006/0193515 | A1 | 8/2006 | Kim et al. | |
| 2006/0274901 | A1 | 12/2006 | Terai et al. | |
| 2008/0107287 | A1 | 5/2008 | Beard | |
| 2008/0175406 | A1 | 7/2008 | Smith | |
| 2010/0215198 | A1 | 8/2010 | Ngia et al. | |
| 2011/0009771 | A1 | 1/2011 | Guillon et al. | |
| 2011/0206217 | A1 | 8/2011 | Weis | |
| 2012/0183161 | A1 | 7/2012 | Agevik et al. | |
| 2012/0328107 | A1 | 12/2012 | Nystrom et al. | |
| 2013/0169779 | A1 | 7/2013 | Pedersen | |
| 2013/0177166 | A1 | 7/2013 | Agevik et al. | |
| 2013/0279724 | A1 | 10/2013 | Stafford et al. | |
| 2014/0161412 | A1 | 6/2014 | Chase et al. | |
| 2014/0270200 | A1 | 9/2014 | Usher et al. | |
| 2015/0010160 | A1 | 1/2015 | Udesen | |
| 2015/0172814 | A1 | 6/2015 | Usher et al. | |
| 2016/0269849 | A1 | 9/2016 | Riggs et al. | |
| 2017/0020382 | A1 | 1/2017 | Sezan et al. | |
| 2017/0332186 | A1 | 11/2017 | Riggs et al. | |
| 2018/0063652 | A1 | 3/2018 | Perkins et al. | |
| 2018/0091921 | A1 | 3/2018 | Silva | |

OTHER PUBLICATIONS

International Application Serial No. PCT/2017/061413, International Search Report dated Mar. 5, 2018, 3 pages.
International Application Serial No. PCT/2017/061413, Written Opinion dated Mar. 5, 2018, 5 pages.
International Application Serial No. PCT/2018/052312, Written Opinion dated Jan. 21, 2019, 7 pages.
International Application Serial No. PCT/US2017/061417, International Search Report dated Mar. 5, 2018, 3 pages.
International Application Serial No. PCT/US2017/061417, Written Opinion dated Mar. 5, 2018, 8 pages.
Torres-Gallegos, et al., "Personalization of Head-Related Transfer Functions (HRTF) Based on Automatic Photo-Anthropometry and Inference From a Database", Applied Acoustics, Elsevier Publishing, GB, vol. 97, Apr. 27, 2015, pp. 84-95.
PCT Application Serial No. PCT/2018/052312, International Search Report dated Jan. 21, 2019, 3 pages.
Spagnol, et al., "Synthetic Individual Binaural Audio Delivery By Pinna Image Processing", International Journal of Pervasive Computing and Communications vol. 10 No. 3, 2014, pp. 239-254, Emerald Group Publishing Limited.
U.S. Appl. No. 15/811,295, Non-Final Office Action, dated Aug. 9, 2018, 13 pages.
U.S. Appl. No. 15/811,386, Notice of Allowance dated Feb. 5, 2018, 7 pages.
U.S. Appl. No. 15/811,642, Non-Final Office Action dated Mar. 15, 2018, 5 pages.
U.S. Appl. No. 15/811,295, Notice of Allowance, dated Feb. 27, 2019, 6 pages.
U.S. Appl. No. 15/811,392, Non-Final Rejection, dated Feb. 13, 2019, 9 pages.
U.S. Appl. No. 15/811,392, Notice of Allowance, dated May 30, 2019, 9 pages.
U.S. Appl. No. 15/811,642, Notice of Allowance, dated Sep. 11, 2018, 5 pages.
U.S. Appl. No. 16/138,931, Non-Final Rejection, dated Aug. 15, 2019, 13 pages.

* cited by examiner

SYSTEM AND METHOD TO VIRTUALLY MIX AND AUDITION AUDIO CONTENT FOR VEHICLES

CROSS-REFERENCE TO RELATED APPLICATIONS

This application claims the benefit of U.S. Provisional Application No. 63/141,911, filed on Jan. 26, 2021. The application is related to U.S. patent application Ser. No. 16/542,930, filed on Aug. 16, 2019 (now U.S. Pat. No. 10,659,908 issued on May 19, 2020), which is continuation of U.S. patent application Ser. No. 15/811,441, filed on Nov. 13, 2017 (now U.S. Pat. No. 10,433,095 issued on Oct. 1, 2019), which claims priority to U.S. Provisional Application No. 62/468,933, filed on Mar. 8, 2017, U.S. Provisional Application No. 62/466,268, filed on Mar. 2, 2017, U.S. Provisional Application No. 62/424,512, filed on Nov. 20, 2016, U.S. Provisional Application No. 62/421,380, filed on Nov. 14, 2016, and U.S. Provisional Application No. 62/421,285, filed on Nov. 13, 2016. The entire disclosures of the applications referenced above are incorporated herein by reference.

FIELD

The present disclosure relates to a system and a method for virtually mixing and auditioning audio content for cars.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Musicians, Producers, and Sound Engineers spend extreme amounts of time, and effort tuning the sound of their creation. One of the main reasons is to ensure that the final mix sounds good across all platforms and devices.

In today's world, people spend a lot of time in cars listening to music. Car audio has also improved tremendously over the last few years particularly in terms of quality. Listening to music in cars has been made even easier with the ease of accessibility to music with different streaming platforms like Spotify, Apple Music, Tidal, Pandora etc.

SUMMARY

A system comprises a sound source, a laser device, a first microphone, a first microphone, and a controller. The sound source is configured to output an audio signal to a plurality of speakers arranged in a plurality of locations in a vehicle. The laser device is disposed on an object representing a human head placed in a seat of the vehicle. The object comprises a first ear and a second ear. The laser device is configured to scan the locations of the speakers. The first microphone is disposed in the first ear of the object. The second microphone is disposed in the second ear of the object. The controller is configured to route the audio signal to the speakers one speaker at a time and to receive audio signals received via the first and second microphones. The controller is configured to compile binaural acoustic data for the vehicle based on the audio signals received via the first and second microphones. The controller is configured to receive scan data from the laser device and to generate geometric data for the vehicle based on the scan data. The controller is configured to generate head-related transfer functions (HRTFs) for the object based on the binaural acoustic data and the geometric data for the vehicle.

In other features, the controller is configured to divide the binaural acoustic data into a first component associated with the object and a second component associate with the vehicle. The controller is configured to decouple the HRTFs from the first component of the binaural acoustic data of the vehicle. The controller is configured to index the HRTFs to the geometric data of the vehicle.

In still other features, the method comprises placing first and second microphones in ears of an object representing a human head. The method comprises arranged a laser device on the object. The method comprises placing the object in a seat of a vehicle. The vehicle comprises speakers arranged in a plurality of locations in the vehicle. The method comprises sending an audio signal to the speakers one speaker at a time and receiving audio signals received by the first and second microphones. The method comprises compiling binaural acoustic data for the vehicle based on the audio signals received by the first and second microphones. The method comprises receiving scan data from the laser device and generating geometric data for the vehicle based on the scan data. The method comprises generating head-related transfer functions (HRTFs) for the object based on the binaural acoustic data and the geometric data for the vehicle.

In other features, the method further comprises compiling additional binaural acoustic data for the vehicle by placing the object in remaining seats of the vehicle. The method further comprises sending the audio signal to the speakers one speaker at a time while the object is placed in each of the remaining seats of the vehicle. The method further comprises receiving the audio signals received by the first and second microphones while the object is placed in each of the remaining seats of the vehicle.

In other features, the method further comprises generating additional geometric data for the vehicle with the object placed in each of the remaining seats of the vehicle.

In other features, the method further comprises generating the HRTFs for the object based on the additional binaural acoustic data and the additional geometric data for the vehicle.

In other features, the method further comprises generating additional HRTFs for the object by placing the object in each seat of additional vehicles.

In other features, the method further comprises dividing the binaural acoustic data of the vehicle and additional binaural acoustic data collected from the additional vehicles into a first component associated with the object and a second component associate with the vehicle and the additional vehicles. The method further comprises decoupling the HRTFs and the additional HRTFs from the first component. The method further comprises indexing the HRTFs and the additional HRTFs to the geometric data of the vehicle and the additional geometric data of the additional vehicles.

In still other features, a non-transitory computer-readable medium stores a computer program comprising instructions which when executed by a processor cause the processor to provide a graphical user interface (GUI) that is interfaced with the computer program comprising head-related transfer functions (HRTFs) generated for an object representing a human head by placing the object in each seat of a plurality of vehicles. The instructions cause the processor to receive an image of an ear of a user and to generate HRTFs of the user based on the image of the ear. The instructions cause the processor to replace the HRTFs of the object with the HRTFs of the user. The instructions cause the processor to receive selections for one of the vehicles and a seat of the one of the vehicles from the user via the GUI. The instructions cause the processor to receive an input audio signal from a sound source. The instructions cause the processor to generate an output audio signal based on the input audio signal and the HRTFs of the user. The instructions cause the processor to output the output audio signal to headphones of the user.

In other features, the computer program comprises geometric data associated with speakers of the one of the vehicles. The instructions further cause the processor to generate, for each of the speakers, an index based on the selections for the one of the vehicles and the seat of the one of the vehicles and corresponding geometric data. The instructions cause the processor to select, for each of the speakers, a corresponding HRTF from the HRTFs of the user based on the index. The instructions cause the processor to convolve, for each of the speakers, the input audio signal with the selected HRTF to generate a binaural output comprising left and right channels. The instructions cause the processor to combine the left channels of the binaural outputs to generate a left component of the output audio signal. The instructions cause the processor to combine the right channels of the binaural outputs to generate a right component of the output audio signal.

In still other features, a method comprises generating a graphical user interface (GUI) that is interfaced with a computer program comprising head-related transfer functions (HRTFs) generated for an object representing a human head by placing the object in each seat of a plurality of vehicles. The method comprises receiving an image of an ear of a user and generating HRTFs of the user based on the image of the ear. The method comprises replacing the HRTFs of the object with the HRTFs of the user. The method comprises receiving selections for one of the vehicles and a seat of the one of the vehicles from the user via the GUI. The method comprises receiving an input audio signal from a sound source and generating an output audio signal based on the input audio signal and the HRTFs of the user. The method comprises providing the output audio signal to headphones of the user.

In other features, the computer program comprises geometric data associated with speakers of the one of the vehicles. The method further comprises generating, for each of the speakers, an index based on the selections for the one of the vehicles and the seat of the one of the vehicles and corresponding geometric data. The method further comprises selecting, for each of the speakers, a corresponding HRTF from the HRTFs of the user based on the index. The method further comprises convolving, for each of the speakers, the input audio signal with the selected HRTF to generate a binaural output comprising left and right channels. The method further comprises generating a left component of the output audio signal by combining the left channels of the binaural outputs. The method further comprises generating a right component of the output audio signal by combining the right channels of the binaural outputs.

In still other features, a system comprises a sound mixer and a computing device. The comprising computing device a computer program. The computer program comprises head-related transfer functions (HRTFs) generated for an object representing a human head by placing the object in each seat of a plurality of vehicles. The computer program is configured to generate a graphical user interface (GUI) on the computing device to allow a user of the sound mixer to select one of the vehicles a seat in the one of the vehicles. The computer program is configured to receive an image of an ear of the user and to generate HRTFs of the user based on the image of the ear. The computer program is configured to replace the HRTFs of the object with the HRTFs of the user. The computer program is configured to receive an input audio signal from the sound mixer and to generate an output audio signal based on the input audio signal and the HRTFs of the user. The computer program is configured to provide the output audio signal to headphones of the user.

Instill other features, a system comprises a sound mixer and a computing device. The comprising computing device a computer program. The computer program comprises binaural acoustic data and geometric data generated by placing an object representing a human head in each seat of a plurality of vehicles. The computer program is configured to receive an image of an ear of a user of the sound mixer. The computer program is configured to receive a selection of one of the vehicles a seat in the one of the vehicles from the user. The computer program is configured to receive an input audio signal from the sound mixer and to generate an output audio signal based on the input audio signal, the image of the ear of the user, and the binaural acoustic data and geometric data of the selected vehicle. The computer program is configured to provide the output audio signal to headphones of the user.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
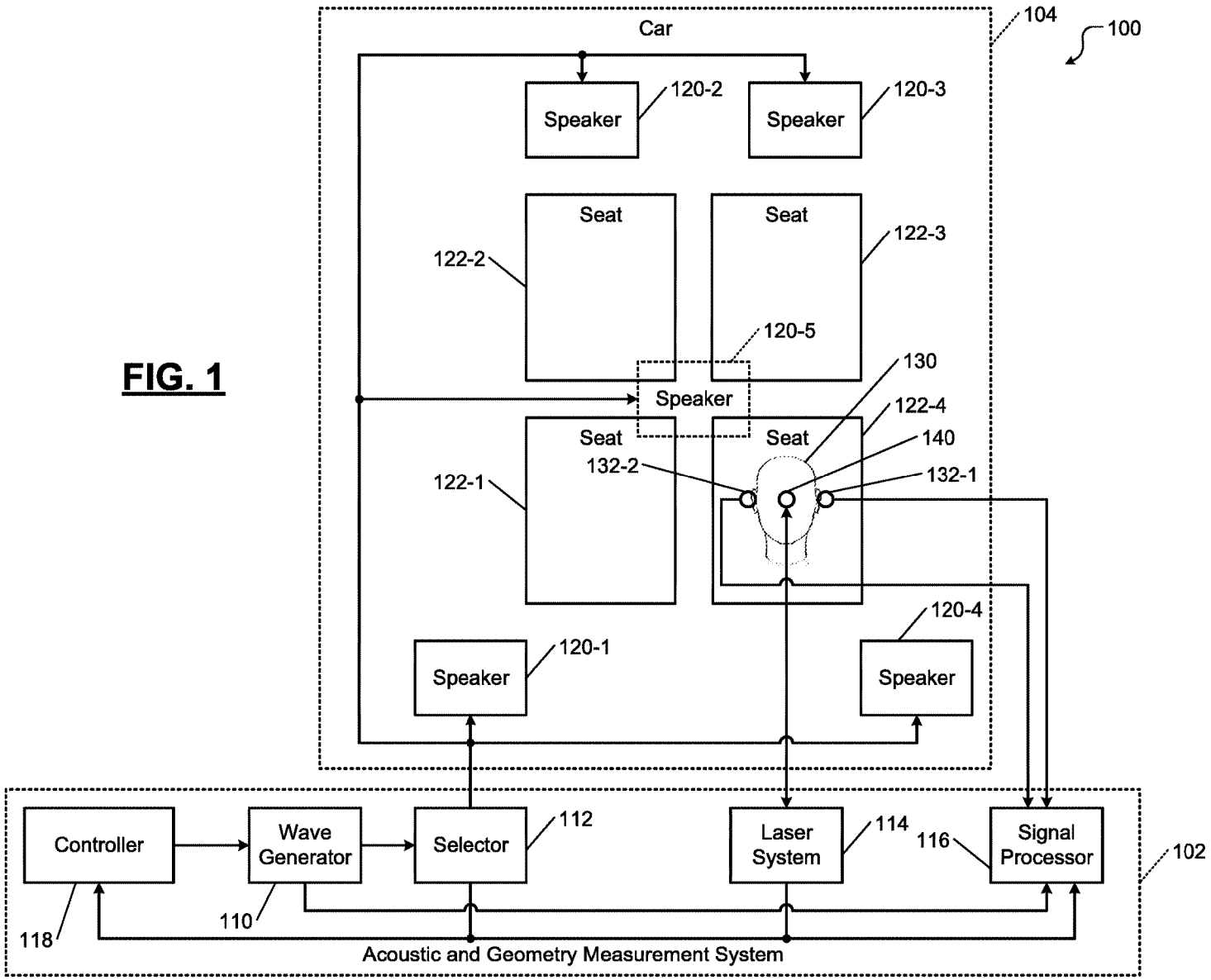
FIG. 1 shows a system to model acoustics and capture geometric measurements of a car according to the present disclosure.

Car acoustics, due to its enclosed space, design, and seats, is extremely complex and results in severely coloring the sound source. In other words, the sound that a car occupant hear in cars, is vastly different from that heard in music studios where the music was originally created. Therefore, there is a need for creators to monitor their music in different cars, and make the necessary adjustments before publishing. The process of physically monitoring a music mix in different cars and adjusting the music mix before publishing the music is extremely time consuming and expensive. Given the tight timeline creators work with, it is practically improbable to physically monitor the final mix on all the different kinds of cars, speakers, seat positions, and to make the adjustments.

The present disclosure provides a system and a method integrated into a Virtual Studio Plugin (a computer program product) using which artists can virtually monitor their final mix in different car environments and adjust the final mix quickly. As explained below in detail, the present disclosure provides a system and a method for modeling acoustics, geometries, and speaker configurations of different cars, and virtually mixing and auditioning audio content in different cars. Throughout the present disclosure, the term car includes any vehicle. Further, while cars are used as illustrative examples, the teachings of the present disclosure can be applied to any enclosed space where recorded music can be played. Non-limiting examples of enclosed spaces include bars, banquet halls, etc.

Specifically, the present disclosure provides a system and a method to virtually monitor and master the final mix within a car environment from anywhere (e.g., from home). The system provides the ability to quickly compare how a mix sounds in different makes and models of cars (e.g., in seconds). The system provides the ability to select different seats in the car and monitor how the mix sounds at each seat location to ensure best quality everywhere in the cars. The system provides the ability to select and monitor individual speakers in the car, which helps in tuning and identifying problems in the mix. The system provides the ability to mix and master surround sound for car audio systems. The system provides the ability to listen to sound recordings using personalized head-related transfer functions (HRTFs), which transports the listener to the sweet spot inside the car. The system and the method use AI technology to quickly calculate personalized spatial audio profiles or HRTFs using a single picture of an ear as input (e.g., in a few seconds).

In addition, the sound in a car is accurately characterized by carrying out detailed acoustic measurements inside the car using a binaural dummy head. The system and the method also personalize early direction-dependent reflections inside the car. The acoustic characteristics of each of the transducers/speakers in the car are also accurately captured in these measurements. Furthermore, the system can allow car manufacturers to monitor and compare different speakers before building audio systems for cars. This ability can save a lot of time, computational resources, labor, and costs for the car manufacturers. This ability also allows the car manufacturers to compare their sound systems with their competitors' sound systems.

More specifically, the method of the present disclosure comprises placing a human dummy head in a selected seat of a car with a microphone placed in each ear of the dummy head. Each speaker in the car is excited at a time, and sounds received by both microphones are captured, which include direct signals received by the microphones from the excited speaker and reflections of sounds received by the two microphones from throughout the car. The procedure of exciting each speaker in turn is repeated by placing the dummy head in every seat of the car. Thus, the acoustic data of the car are captured binaurally (using two microphones) for each speaker and for each seat of the car. Note that in each seat, the sounds from different speakers and the reflections travel different paths to the microphones in the ears, which are binaurally captured by the above procedure.

Further, the speakers arranged throughout the car are at different geometric locations relative to each seating position. Specifically, the azimuth, elevation angle, and distance of each speaker are different relative to different seat locations in the car. The geometric measurements (i.e., the azimuth, elevation angle, and distance of each speaker relative to each seat) are captured using a laser device installed on the dummy head (e.g., at the nose, forehead, chin, or top of the dummy head). The laser device scans the geometric arrangement of the speakers from each seat, and the geometric measurements for each speaker relative to each seat are captured.

The acoustics and the geometric measurements for various cars collected as described above are stored in a server in a cloud and are utilized to virtually mix music recorded by an artist as follows. A musician or a mixing technician (collectively called the user) downloads a computer program product from the server onto a personal computing device. The computer program product displays a graphical user interface (GUI) on the computing device. The GUI displays drop-down menus on the computing device using which the user can select a car and a seat for which to optimize the mix.

The user takes a picture of an ear of the user and inputs the image of the ear into the computer program product. In the computer program product, the acoustic and geometric measurements were captured from the perspective of the dummy head whereas actual anatomy of the ear varies from individual to individual. Further, the ear of each person is correlated to the size and shape of the head of the person, which also differs from the size and shape of the dummy head. Therefore, the program product computes a Head-related transfer function (HRTF) based on the image of the ear of the user and replaces the HRTF of the dummy head with the HRTF of the ear.

The replacement is feasible because in the computer program product, which is generated in the server by post-processing the acoustic data, the HRTFs generated based on the acoustic data collected using the dummy head (i.e., based on the anatomy of the ear of the dummy head) are decoupled from a component of the acoustic data associated with the dummy head. By swapping the HRTF of the dummy head with the HRTF of the ear of the user, the mixing generated by the user based on the HRTF of the actual ear of the user can provide a personalized listening experience to the user in the selected car and the selected seat. These and other features of the present disclosure are described below in detail.

FIG. 1 shows a system 100 to model acoustics and capture geometric measurements of a car according to the present disclosure. The system 100 comprises an acoustic and geometric measurement system 102 and a car 104. The measurement system 102 comprises a signal generator 110, a selector 112, a laser processor 114, a signal processor, and a controller 118. Note that one or more components of the measurement system 102 can be combined with the controller 118 or with the other components of the measurement system 102. For example, the laser processor 114 can be integrated with the laser device 140.

The car 104 comprises a plurality of speakers 120-1, 120-2, 120-3, 120-4, and 120-5 (collectively the speakers 120). While five speakers are shown for illustrative purposes, the car 104 can comprise fewer or more than five speakers. The car 104 comprises a plurality of seats 122-1, 122-2, 122-3, and 122-4 (collectively the seats 122). While four seats are shown for illustrative purposes, the car 104 can comprise fewer or more than four seats.

A dummy head 130 is placed in a seat (e.g., the seat 122-4). Throughout the present disclosure, while a dummy head is used, the dummy head can be replaced by any object representative of the anatomy of a human head, including by a human being. The dummy head 130 comprises a first microphone 132-1 and a second microphone 132-2 (collectively the microphones 132) placed in left and right ears of the dummy head 130, respectively. A laser device 140 comprising a laser transmitter and receiver is placed on the dummy head 130. For example, the laser device can be placed on the nose, chin, forehead, or top of the dummy head 130.

The acoustic measurement of the car 104 is described below in detail with reference to FIG. 2. Briefly, to measure the acoustic characteristics of the car 104, the measurement system 102 performs the following procedure with the dummy head 130 placed in each seat 122 of the car 104. The signal generator 110 generates an audio signal. The selector 112 selects one of the speakers 120 to route the audio signal to the speakers 120 one speaker at a time. Audio signals output by the speakers 120 and reflections from within the car 104 are received by the microphones 132. The audio signals received by the microphones 132 are input to the signal processor 116. The signal processor 116 processes the audio signals received from the microphones 132 and outputs data to the controller 118. The controller 118 compiles binaural acoustic data for the car 104 based on the data received from the signal processor 116 as described below in further detail with reference to FIG. 2.

The geometric measurements of the car 104 are described below in detail with reference to FIG. 3. Briefly, to capture the geometric measurements of the car 104, the measurement system 102 performs the following procedure with the dummy head 130 placed in each seat 122 of the car 104. The laser device 140 transmits a laser beam to each of the speakers 120 and receives reflections from each of the speakers 120. The laser device 140 generates geometric data regarding the locations of the speakers 120 in the car 104 relative to each seat 122. For example, the geometric data includes the azimuth, elevation angle, and distance of each speaker 120 relative to each seat 122 as described below in further detail with reference to FIG. 3. The laser processor 114 processes the geometric data received from the laser device 140 and outputs the geometric data to the controller 118. The controller 118 stores the geometric data for the car 104.

The controller 118 processes the acoustic data and the geometric data of the car 104 to generate HRTFs for the dummy head 130. The controller 118 divides the acoustic data into two components: one component associated with the dummy head 130, and another component associated with the car 104. The controller 118 decouples the HRTFs from the component of the acoustic data associated with the dummy head 130. The controller 118 indexes the HRTFs to the geometric data. The controller 118 performs the procedure described above for multiple cars. The controller 118 generates a computer program product, which is an image or code executable by a processor of a computing device (e.g., a personal computer, a handheld computing device, etc.) used by a musician or a recording technician (collectively the user) to mix music as described below in detail with reference to FIGS. 5-9.

Briefly, the computer program product executed on the computing device of the user provides a graphical user interface (GUI) on the computing device. The user uses the GUI to select a car and a seat. The computer program product projects a virtual model of the selected car including the seats in the car and the speakers in the car. The user inputs an image of an ear of the user into the computer program product. The computer program product generates HRTFs based on the image and replaces the HRTFs of the dummy head 130 with the HRTFs of the user. The user inputs an input audio signal (e.g., a music track) from a sound mixer into the computer program product. The computer program product generates an output audio signal based on the HRTFs of the user and the acoustic data and the geometric data of the selected car and seat, and outputs the output audio signal to the headphones of the user. The user hears the output audio signal as if the user were physically sitting in the selected seat in the selected car. The user can adjust the sound mixer until the output audio signal attains a desired quality. The user can select multiple cars and repeat the above procedure until the music mix is perfected. Thereafter, the user can publish the music mix.

In order to virtually model a car (e.g., the car 104) using the measurement system 102, the acoustics inside the car needs to be accurately measured. There are several methods of capturing acoustics such as Mid-Side recording, free-field microphone, multi-microphone array, Ambisonics, and Binaural microphones. To capture how humans hear sounds in real life, a Head and Torso Simulator (HATS) Dummy Head (e.g., the dummy head 130) is used. The dummy head includes microphones (e.g., the microphones 132) at the eardrums and is equipped with ear lobes that approximate average anthropometric (size, shape, etc.) characteristics of the human population. An excitation source (e.g., the signal generator 110) such as an exponential sine-sweep is played from each of the speakers (e.g., the speakers 120) inside the car. The excitation signal contains all the frequencies from 0 to 20 kHz, which correspond to the human hearing bandwidth. The excitation signal also provides high signal-to-noise ratio in the measurements. The microphones in the ears of the dummy head capture the excitation signal, which simulates how humans naturally hear sounds. From and the excitation signal (input) and the signals (output) captured by the microphones, an impulse response or a transfer function of the speaker-car environment system can be computed as follows.

Impulse Response Or Transfer Function=Microphone Captured Signal/Excitation Signal A software like FuzzMeasure or Matlab can be used to send the excitation signal and record the outputs of the microphones in the dummy head at the same time. The microphone signals are first pre-conditioned using a signal processor (e.g., the signal processor 116), which also comprises a pre-amplifier. Measurements are computed at high-resolution to facilitate high sampling rates.

This procedure is repeated by placing the HATS dummy head in each seat (e.g., the seat 122) of the car and exciting each of the speakers. Impulse responses are computed for each seat of the car and speaker combination since every seat in the car will have a unique listening experience. Therefore, the acoustic response for each seat location is accurately measured at high-resolution.

Along with the acoustic measurements captured as described above, geometrical measurements are also captured for each speaker and listener (i.e., seat) position. For each speaker, the azimuth, elevation angle, and distance are measured using a laser measurement device (e.g., the laser device 140 and the laser processor 114). These calculations are used to compute relative delays between each speaker for a particular listener location. The delays are essentially the relative difference of the time taken for the sound to travel from each speaker (in the car) to the dummy head's ears (left and right). Another reason to accurately know the position of the speaker with respect to the listener position is to accurately use the correct head-related transfer functions or spatial filters in the virtual environment to give a truly immersive experience.

Figure 2:
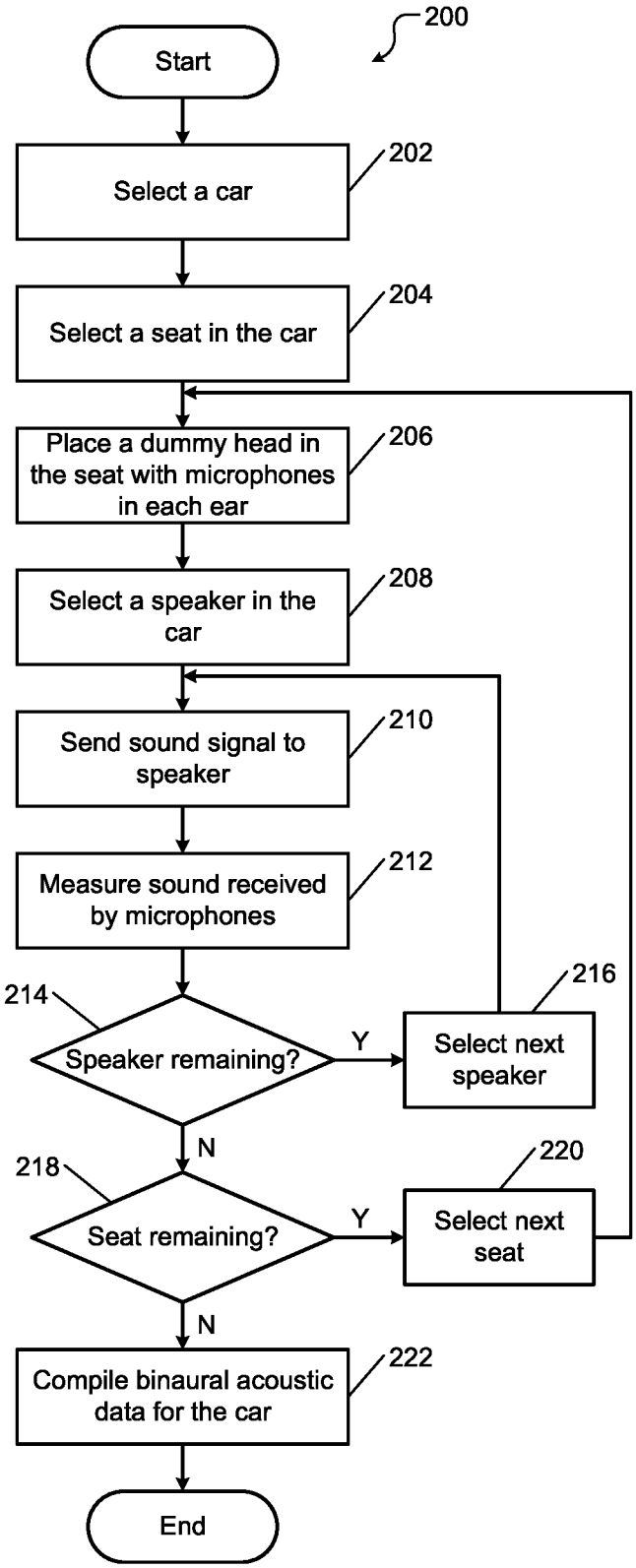
FIG. 2 shows a method executed by the system of FIG. 1 to measure binaural acoustic data of the car.

FIG. 2 shows a method 200 executed by the measurement system 102 (e.g., by the controller 118). At 202, the method 200 includes selecting a car (e.g., the car 104 shown in FIG. 1) for measuring the acoustic data and the geometric data of the car. At 204, the method 200 includes selecting a seat (e.g., a seat 122 shown in FIG. 1) in the car. At 206, the method 200 includes placing a dummy head (e.g., the dummy head 130 shown in FIG. 1) in the selected seat. The dummy head includes microphones (e.g., the microphones 132 shown in FIG. 1) in the ears. At 208, the method 200 includes selecting a speaker (e.g., a speaker 120 shown in FIG. 1). At 210, the method 200 includes sending a sound signal (e.g., from the signal generator 110 shown in FIG. 1) to the selected speaker. At 212, the method 200 includes measuring the sound received by the microphones.

At 214, the method 200 determines if the above procedure (i.e., steps 210 and 212) has been performed on every speaker in the car. If any of the speakers remains to be excited by the sound signal (i.e., if the above procedure described in steps 210 and 212 has not been performed on every speaker in the car), at 216, the method 200 selects the next speaker in the car, and the method 200 returns to 210 to repeat the above procedure described in steps 210 and 212 on the remaining speakers in the car.

If none of the speakers remains to be excited by the sound signal (i.e., if the above procedure described in steps 210 and 212 has been performed on every speaker in the car), at 218, the method 200 determines if the above procedure (i.e., steps 206 to 216) has been performed with the dummy head placed in every seat of the car. If any of the seats remains (i.e., if the above procedure described in steps 206 to 216 has not been performed with the dummy head placed in every seat in the car), at 220, the method 200 selects the next seat in the car, and the method 200 returns to 206 to repeat the above procedure described in steps 206 to 216 with the dummy head placed in the remaining seats in the car.

If none of the seat remains (i.e., if the above procedure described in steps 206 to 216 has been performed with the dummy head placed in every seat in the car), at 222, the method 200 compiles binaural acoustic data for the car based on all of the data collected from the microphones after exciting every speaker in the car with the dummy head placed in every seat in the car. The method 200 ends. The binaural acoustic data collected using the method 200 is utilized by the measurement system 102 as shown and described below with reference to FIGS. 4-9.

Figure 3:
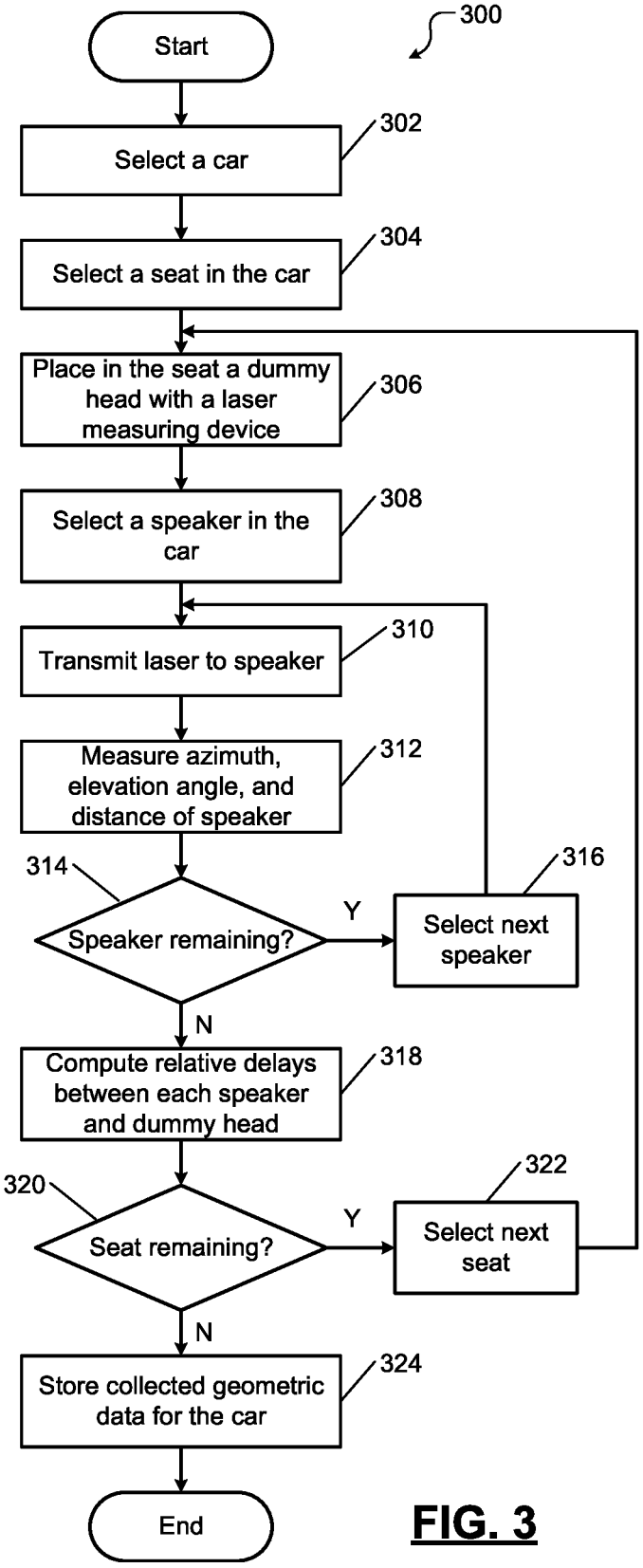
FIG. 3 shows a method executed by the system of FIG. 1 to measure geometric acoustic data of the car.

FIG. 3 shows a method 300 executed by the measurement system 102 (e.g., by the controller 118). Note that the methods 200 and 300 can be performed concurrently. At 302, the method 300 includes selecting a car (e.g., the car 104 shown in FIG. 1) for measuring the acoustic data and the geometric data of the car. At 304, the method 300 includes selecting a seat (e.g., a seat 122 shown in FIG. 1) in the car. At 306, the method 300 includes placing a dummy head (e.g., the dummy head 130 shown in FIG. 1) in the selected seat. The dummy head includes a laser device (e.g., the laser device 140 shown in FIG. 1) arranged on the dummy head as described above with reference to FIG. 1.

At 308, the method 300 includes selecting a speaker (e.g., a speaker 120 shown in FIG. 1). At 310, the method 300 includes transmitting a laser beam to the selected speaker and receiving reflections from the selected speaker (i.e., scanning the selected speaker using the laser device 140). At 312, the method 300 includes measuring geometric data comprising the azimuth, elevation angle, and distance of the selected speaker relative to the selected seat based on the transmitted and received laser beams (e.g., by using the laser device 140 and/or the laser processor 114 shown in FIG. 1).

At 314, the method 300 determines if the above procedure (i.e., steps 310 and 312) has been performed on every speaker in the car. If any of the speakers remains to be scanned by the laser beam (i.e., if the above procedure described in steps 310 and 312 has not been performed on every speaker in the car), at 316, the method 300 selects the next speaker in the car, and the method 300 returns to 310 to repeat the above procedure described in steps 310 and 312 on the remaining speakers in the car. If none of the speakers remains to be scanned by the laser beam (i.e., if the above procedure described in steps 310 and 312 has been performed on every speaker in the car), at 318, the method 300 computes relative delays between each speaker and the dummy head based on the geometric data collected from the speakers.

At 320, the method 300 determines if the above procedure (i.e., steps 306 to 318) has been performed with the dummy head placed in every seat of the car. If any of the seats remains (i.e., if the above procedure described in steps 306 to 318 has not been performed with the dummy head placed in every seat in the car), at 322, the method 300 selects the next seat in the car, and the method 300 returns to 306 to repeat the above procedure described in steps 306 to 318 with the dummy head placed in the remaining seats in the car.

If none of the seat remains (i.e., if the above procedure described in steps 306 to 318 has been performed with the dummy head placed in every seat in the car), at 324, the method 300 stores the geometric data for the car including all of relative delays and the geometric data collected from the laser device 140 after scanning every speaker in the car with the dummy head placed in every seat in the car. The method 300 ends. The relative delays and the geometric data collected using the method 300 are utilized by the measurement system 102 as shown and described below with reference to FIGS. 4-9.

Once the acoustic and geometric measurements are accurately computed, the measurements are integrated into a computer program product that provides a virtual studio environment with personalized spatial audio. Personalized spatial audio allows achieving maximum immersion and realism in a virtual music production system. In order to have a true personalized spatial audio, head-related transfer functions (HRTFs) are accurately measured uniquely for every listener. In free-field conditions, the sound radiated from a sound source reaches the ears after undergoing complex interactions, such as diffractions and reflections with the anatomical structures (head, torso, and pinnae) of the listener. The resultant signal at the eardrum contains several cues, such as the interaural time differences (ITD), interaural level differences (ILD), and the spectral cues (SC) that the human auditory system uses to locate a sound source. HRTFs contain information about these cues. The characteristics of a HRTF depends on the ear geometry to a large extent and thus is unique for every individual. HRTF is also sometimes referred to as an Acoustic fingerprint due to its idiosyncratic nature.

Figure 4:
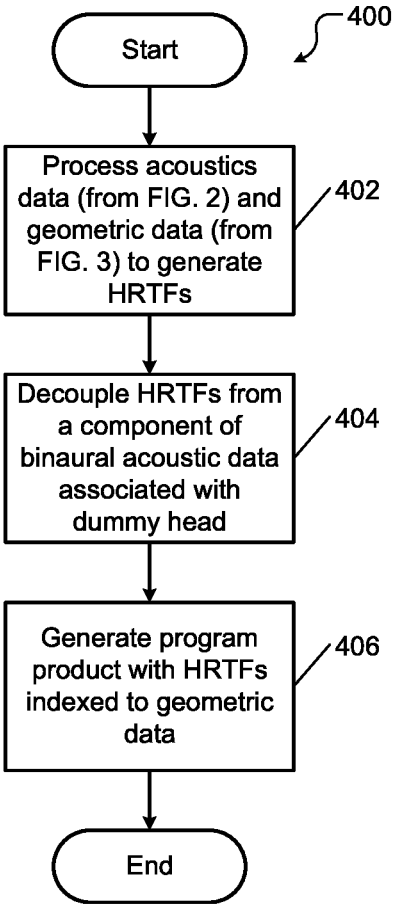
FIG. 4 shows a method executed by the system of FIG. 1 to process the binaural acoustic data collected using the method of FIG. 2 and the geometric data collected using the method of FIG. 3 and to generate a computer program product.

FIG. 4 shows a method 400 executed by the measurement system 102 (e.g., by the controller 118) to process the binaural acoustic data collected using the method 200 and the geometric data collected using the method 300. At 402, the method 400 process the binaural acoustic data collected using the method 200 and the geometric data collected using the method 300. The method 400 generates HRTFs for the dummy head based on the binaural acoustic data collected using the method 200 and the geometric data collected using the method 300. At 404, the method 400 divides the binaural acoustic data into a component associated with the dummy head and another component associated with the car, and decouples the HRTFs from the component of the binaural acoustic data associated with the dummy head. At 406, the method 400 generates a computer program product comprising the HRTFs indexed to the geometric data.

The computer program product additionally comprises a GUI that the user can use to select any car for which the acoustic and geometric data has been collected using the system and methods described above with reference to FIGS. 1-3. Further, the GUI allows the user to select any seat in the car, any speaker in the car, and audition and mix music until the music mix is perfected for all of the cars using the virtual environment for the cars provided by the computer program product. The user can then publish the music mix.

Figure 5:
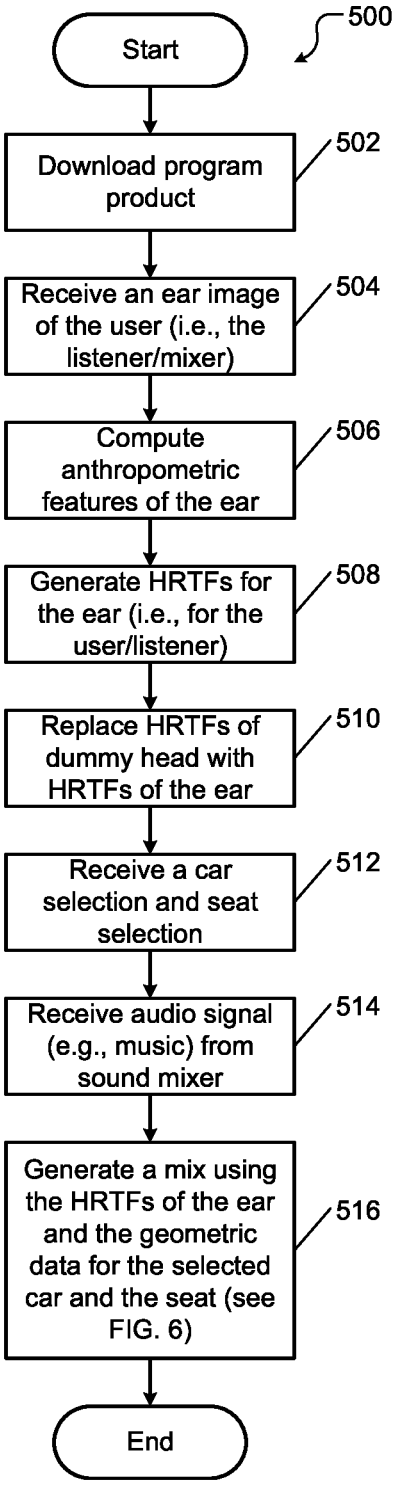
FIG. 5 shows a method performed by the computer program product of FIG. 4 when downloaded and executed on a computing device of a user to virtually audition and mix music on the computing device of the user.

FIG. 5 shows a method 500 performed by the computer program product downloaded and executed on a computing device of the user. The computing device may comprise a music mixing program or may be connected to an external sound mixer. The internal or external sound mixer provides the audio signals (e.g., a music track) to the computing device. The computer program product processes the audio signals and outputs a binaural output comprising a music mix to headphones worn by the user by simulating a virtual environment of any car as described below.

At 502, the method 500 downloads the computer program product, which is generated using the system and methods described above with reference to FIGS. 1-3, from a server in a cloud (e.g., see FIG. 8 and the description of FIG. 8 below). At 504, the method 500 receives an image of an ear of the user. For example, the image may be captured by the computing device of the user or may be input into the computing device of the user (e.g., from a camera, a phone, or the Internet). At 506, the method 500 computes anthropometric features of the ear. At 508, the method 500 generates HRTFs for the ear (i.e., for the user) by processing the image of the ear. For example, AI based methods automatically segment the image, compute the unique anthropometric features of the ear, and generate personalized HRTFs for the user. Further details regarding processing the image and generating HRTFs can be found in the related applications listed above.

At 510, the method 500 replaces the HRTFs of the dummy head in the computer program product with the HRTFs of the user so that the user can have a personalized listening experience instead of a generalized experience that would be otherwise provided by using the HRTFs of the dummy head. The replacement is feasible because in the computer program product, the HRTFs of the dummy head are decoupled from the component of the acoustic data associated with the dummy head.

At 512, the method 500 receives a selection of a car and a seat in the car from the user via the GUI. At 514, the method 500 receives an audio signal from the sound mixer. At 516, the method 500 generates a mix using the HRTFs of the user and the geometric data for the selected car and seat that is output to headphones of the user. Step 516 is described below in further detail with reference to FIG. 6.

Figure 6:
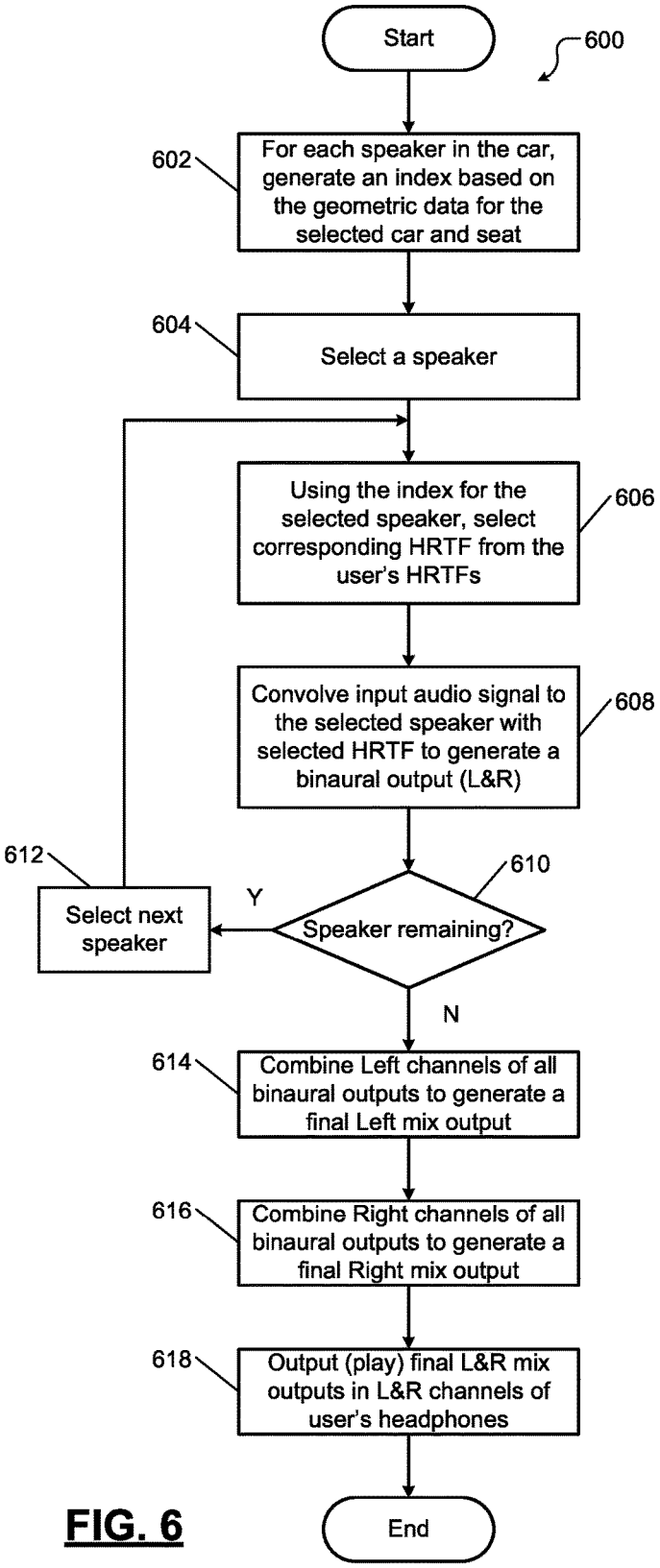
FIG. 6 shows the method of FIG. 5 in further detail.

FIG. 6 shows a method 600 performed by the computer program product downloaded and executed on a computing device of the user. At 602, for each speaker in the selected car, the method 600 generates an index based on the geometric data for the selected car and seat. At 604, the method 600 selects a speaker in the selected car. At 606, using the index for the selected speaker, the method 600 selects corresponding HRTF from the HRTF of the user. At 608, the method 600 convolves the input audio signal received from the sound mixer to the selected speaker with the selected HRTF of the user to generate a binaural output comprising a left channel and a right channel.

At 610, the method 600 determines if any of the speakers in the car is remaining (i.e., for which steps 606 and 608 are not yet performed). If any speaker is remaining, at 612, the method 600 selects the next speaker in the car, and the method 600 returns to 606 to repeat steps 606 and 608 for the next speaker. If no speaker is remaining (i.e., if steps 606 and 608 have been performed for all speakers in the car), at 616, the method 600 combines the left channels of all binaural outputs generated for all the speakers to generate a left component of an output audio signal to be output to the headphones of the user. At 618, the method 600 combines the right channels of all binaural outputs generated for all the speakers to generate a right component of the output audio signal to be output to the headphones of the user. At 618, the method 600 outputs the left and right components to left and right headphones of the user, respectively.

The user can repeat the methods 500 and 600 for as many cars as are supported by the computer program product by selecting any of the cars and any seats in the cars to audition the music and adjust the mix based on the personalized listening experience provided by the computer program product as described above. Thereafter, the user can publish the perfected music mix.

The computer program product provides virtual auditioning capabilities by integrating five components: measured car acoustic responses, speaker responses, speaker delays, and headphone responses and personalized HRTFs. The computer program product utilizes these components as follows. The input audio is first filtered (which is convolution in DSP terminology) with the personalized HRTF that is generated as described above. The left and right channels of input audio are independently filtered with the HRTF for every speaker location (azimuth, elevation, and distance) since the HRTF is unique for every location in 3D space. The filtered output is then convolved with the binaural impulse responses measured for each speaker for a particular listener position (i.e., seat location) since every speaker has a unique speaker response or frequency response. The pre-computed relative delays are then added to this output after applying the speaker response to avoid any phase cancellations during the rendering of the resultant binaural output via the headphones. The binaural output can be played back over any pair of headphones.

Just like a speaker, every headphone has a unique frequency response. Due to headphone-ear coupling, no headphone is acoustically transparent and thus modifies the incoming frequency response. Headphone responses can be empirically measured by placing the headphones on the dummy head and measuring the impulse responses using the methods described above. Once the headphone responses are obtained, the headphone equalization (EQ) is measured by taking the inverse of this response. However, headphone equalization will not result in an accurate reproduction of the desired studio sound. Performing just headphone equalization would create a flat headphone response, which often does not result in a good listening experience. Starting with the inverse response as a reference, acoustical tuning is performed using listening experiments in order to obtain the final headphone EQ. For best listening experience, headphone EQs can also be personalized as EQ depends on the headphone-ear coupling which varies from individual to individual.

Figure 7:
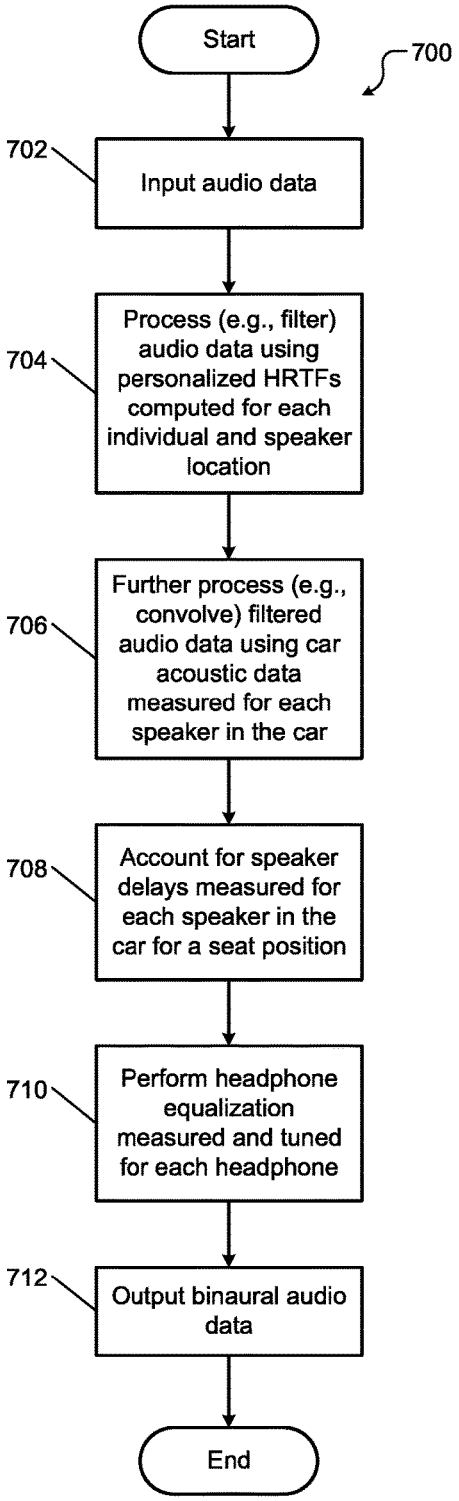
FIG. 7 shows a method performed by the computer program product of FIG. 4 when downloaded and executed on a computing device of a user to virtually audition and mix music on the computing device of the user.

FIG. 7 shows a method 700 performed by the computer program product downloaded and executed on a computing device of the user. At 702, the method 700 receives as input audio data from a sound mixer. At 704, the method 700 processes (e.g., filters) the audio data using personalized HRTFs computed for each user (using an image of the ear of the user) and speaker location. At 706, the method 700 further processes (e.g., convolves) the filtered audio data using the acoustic data measured for each speaker in the car (collected as described above with reference to FIGS. 1 and 2). At 708, the method 700 accounts for the relative delays for the speakers in the car (determined as described above with reference to FIGS. 1 and 3) relative to a seat in the car. At 710, the method 700 performs headphone equalization empirically measured and tuned for each headphone. At 712, the method 700 outputs binaural audio data to the headphones of the user after the audio data received as input from the sound mixer is processed as described above in steps 704-710.

Figure 8:
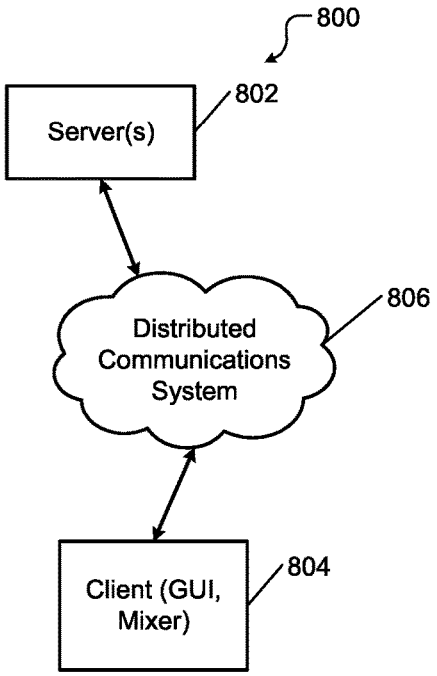
FIG. 8 shows a system for downloading the computer program product of FIG. 4 from a server on a computing device of a user to virtually audition and mix music on the computing device of the user.

FIG. 8 shows a system 800 for auditioning music using a virtual car environment and perfecting a music mix for different cars using the computer program product. The system 800 comprising one or more servers 802 and one or more client devices 804. The one or more servers 802 (hereinafter the server 802) and the one or more client devices 804 (hereinafter the client device 804) communicate via a network 806. The network 806 may comprise a distributed communications system such as a local area network (LAN), a wide area network (WAN), and/or the Internet. The client device 804 is similar to the computing device described above.

The server 802 stores the computer program product generated as described above with reference to FIGS. 1-4. The client device 804 can download the computer program product from the server 802 via the network 806. The computer program product implements a GUI on the client device 804 that the user of the client device 804 can use to audition music as described above with reference to FIGS. 4-6. The client device 804 also includes an internal or external sound mixer to mix the music for cars using the computer program product as described above. Alternatively, the computer program product can also be distributed from the server 802 to the client device 804 via the network 806 as software-as-a-service (SaaS).

Figure 9:
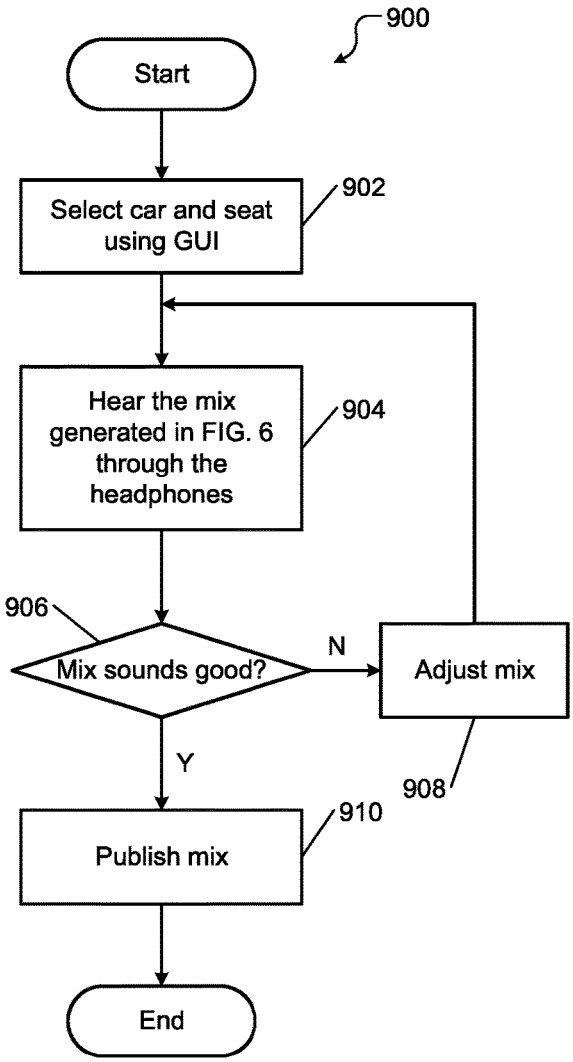
FIG. 9 shows a method performed by the user using the computer program product of FIG. 4 downloaded from a server on a computing device of the user to virtually audition and mix music on the computing device of the user.

FIG. 9 shows a method 900 of auditioning music on the client device 804 using the computer program product. At 902, the user selects a car and a seat using the GUI on the client device 804. At 904, the user inputs music into the computer program product and listens to a music mix comprising personalized binaural output provided by the computer program product via headphones worn by the user. The user experiences the music in the virtual environment provided by the computer program product on the client device 204 as would be experienced in the actual physical car through the speakers of the car in any seat of the car.

At 906, the user determines if the music mix output by the computer program product through the headphones sounds good (i.e., has a predetermined or desired quality). If the quality is not as desired, at 909, the user adjusts the sound mixer. The adjusted mix is processed by the computer program product, and the user continues to listen to the output provided by the computer program product to the headphones until the quality is as desired.

At 910, after the desired quality is achieved, the user publishes the music mix that was input to the computer program product and that resulted in the music of the desired quality as heard through the headphones. The published music will sound the same (i.e., will have the desired quality) when played through the speakers in the physical car in any seat of the car as heard by the user through the headphones on the client device 804.

Thus, the computer program product for virtually auditioning and mastering music mix for cars comprises several innovative features that allow users to accurately audition and mix audio virtually inside a car. The following are non-limiting examples of the innovative features.

The computer program product and the GUI integrate the acoustic responses of different cars. Users can audition, mix, and master audio in different cars by just clicking on the car selector on the GUI. After selecting a particular car, the respective binaural responses and the speaker responses are loaded by the computer program product to facilitate DSP for audio processing. Users can also tune the energy of the ambience or reflections inside the virtual car by adjusting an ambience slider.

The computer program product is flexible and allows the listener to select any seat in the car and virtually audition music as if the listener was physically seated in that seat. Any seat can be selected by clicking the respective seat from a seat-selector in the GUI. After selecting the seat, the binaural impulse responses and the relative speaker delays (with respect to the listener position) are loaded in the DSP for real-time audio processing. This feature allows immense flexibility to compare between the sound experience from different seats within a car.

In the GUI, users can also click on different speakers within the car and solo/mute (i.e., select or deselect) the audio output of that particular speaker. In most cars, one cannot solo or mute individual speakers within the car. Therefore, this feature is incredibly useful in understanding the audio coming from individual speakers and troubleshooting frequency dips and peaks often encountered in mixing. When a particular speaker is selected, the corresponding speaker response and binaural impulse response is loaded (or unloaded) in the DSP. The GUI allows turning on a latch mode to solo or mute multiple speakers at the same time.

The computer program product for virtual car-auditioning is a versatile tool that aids in mixing and mastering surround sound. Due to the tool, mixing engineers do not have to spend an incredible amount of time inside a car mixing and auditioning content, which can be expensive and exhausting. The tool allows the mixing engineers to choose any multi-channel format (5.1, 7.1, 7.1.2, 7.1.4, 9.1.6, etc.) and virtually mix music in that environment all within a single screen. Upon selecting a playback format in the GUI, only the speakers corresponding to the selected format are enabled while rest of the speakers are disabled. Thus, the tool significantly improves the technical field of mixing music.

Figure 10:
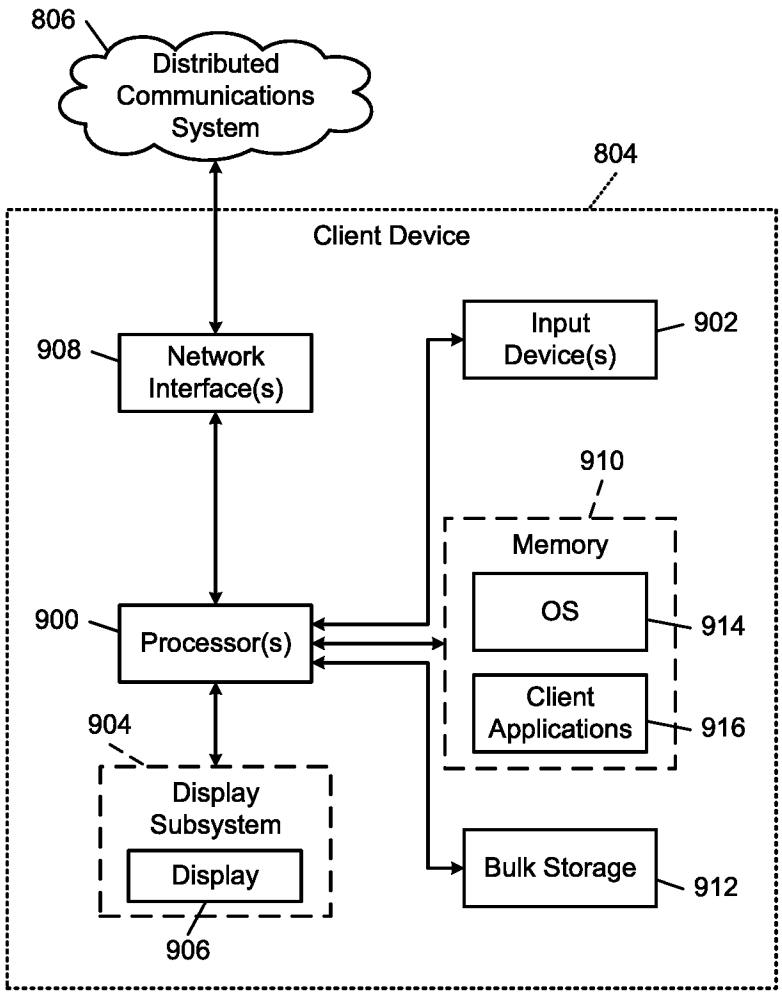
FIG. 10 shows an example of the computing device of FIG. 8.

FIG. 10 shows a simplified example of the client device 804. The client device 804 may typically include one or more central processing unit (CPU), one or more graphical processing unit (GPU), and one or more tensor processing unit (TPU) (collectively shown as processor(s) 900), one or more input devices 902 (e.g., a keypad, touchpad, mouse, touchscreen, detectors or sensors such as cameras, etc.), a display subsystem 904 including a display 906, a network interface 908, memory 910, and bulk storage 912.

The network interface 908 connects the client device 804 to the server 802 via the distributed computing system 806. For example, the network interface 908 may include a wired interface (e, an Ethernet, EtherCAT, or RS-485 interface) and/or a wireless interface (e.g., Wi-Fi, Bluetooth, near field communication (NFC), or other wireless interface). The memory 910 may include volatile or nonvolatile memory, cache, or other type of memory. The bulk storage 912 may include flash memory, a magnetic hard disk drive (HDD), and other bulk storage devices.

The processor 900 of the client device 804 executes an operating system (OS) 914 and one or more client applications 916. The client applications 916 include an application that accesses the server 802 via the distributed communications system 806. The client applications 916 include the computer program product downloaded or accessed from the server 802. The client applications 916 also include applications that perform other operations described above with reference to FIGS. 5-8.

Figure 11:
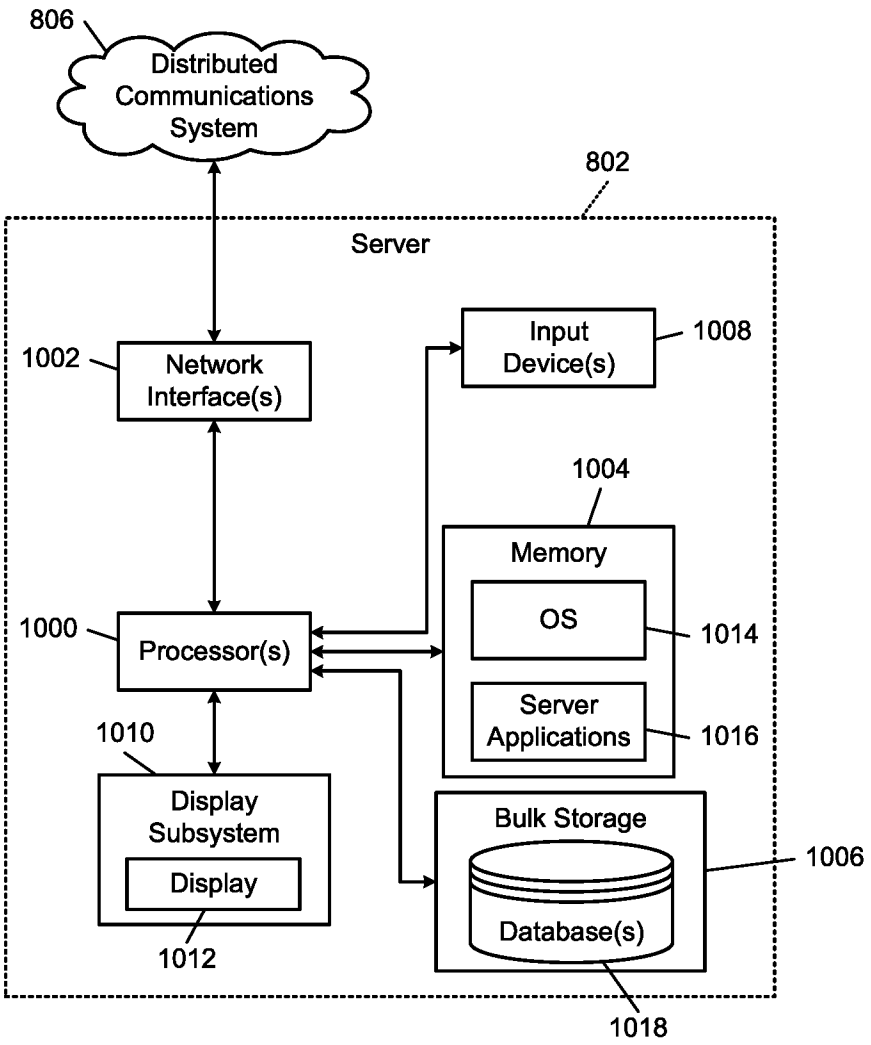
FIG. 11 shows an example of the server of FIG. 8.

FIG. 11 shows a simplified example of the server 802. The server 802 typically includes one or more CPUs/GPUs/TPUs or processors 1000, a network interface 1002, memory 1004, and bulk storage 1006. In some implementations, the server 802 may be a general-purpose server and may include one or more input devices 1008 (e.g., a keypad, touchpad, mouse, etc.) and a display subsystem 1010 including a display 1012.

The network interface 1002 connects the server 802 to the distributed communications system 806. For example, the network interface 1002 may include a wired interface (e.g., an Ethernet or EtherCAT interface) and/or a wireless interface (e.g., a Wi-Fi, Bluetooth, near field communication (NFC), or other wireless interface). The memory 1004 may include volatile or nonvolatile memory, cache, or other type of memory. The bulk storage 1006 may include flash memory, one or more magnetic hard disk drives (HDDs), or other bulk storage devices.

The processor 1000 of the server 802 executes one or more operating system (OS) 1014 and one or more server applications 1016, which may be housed in a virtual machine hypervisor or containerized architecture with shared memory. The bulk storage 1006 may store one or more databases 1018 that store data structures used by the server applications 1016 to perform respective functions. The server applications 1016 include applications that perform the operations described above with reference to FIGS. 1-4 to generate the computer program product for providing the functionality described above with reference to FIGS. 5-8.

The foregoing description is merely illustrative in nature and is not intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure.

Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between controllers, processors, circuit elements, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "controller" or the term "processor" may be replaced with the term "circuit." The term "controller" or the term "processor" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The controller may include one or more interface circuits. In some examples, the interface circuits may include wired or wireless interfaces that are connected to a local area network (LAN), the Internet, a wide area network (WAN), or combinations thereof. The functionality of the controller or the processor of the present disclosure may be distributed among multiple controllers or processors that are connected via interface circuits. For example, multiple controllers or processors may allow load balancing.

The term code or computer program product, as used above, may include software, firmware, and/or microcode, and may refer to programs, routines, functions, classes, data structures, and/or objects. The term shared processor circuit encompasses a single processor circuit that executes some or all code from multiple controllers or processors. The term group processor circuit encompasses a processor circuit that, in combination with additional processor circuits, executes some or all code from one or more controllers or processors. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple controllers or processors. The term group memory circuit encompasses a memory circuit that, in combination with additional memories, stores some or all code from one or more controllers or processors.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general-purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system comprising:

a sound source configured to output an audio signal to a plurality of speakers arranged in a plurality of locations in a vehicle;

a laser device disposed on an object representing a human head placed in a seat of the vehicle, the object comprising a first ear and a second ear, the laser device configured to scan the locations of the speakers;

a first microphone disposed in the first ear of the object;

a second microphone disposed in the second ear of the object; and a controller configured to route the audio signal to the speakers one speaker at a time;

receive audio signals received via the first and second microphones;

compile binaural acoustic data for the vehicle based on the audio signals received via the first and second microphones;

receive scan data from the laser device;

generate geometric data for the vehicle based on the scan data; and generate head-related transfer functions (HRTFs) for the object based on the binaural acoustic data and the geometric data for the vehicle.

2. The system of claim 1 wherein the controller is configured to:

divide the binaural acoustic data into a first component associated with the object and a second component associate with the vehicle;

decouple the HRTFs from the first component of the binaural acoustic data of the vehicle; and index the HRTFs to the geometric data of the vehicle.

3. A method comprising:

placing first and second microphones in ears of an object representing a human;

arranging a laser device on the object;

placing the object in a seat of a vehicle, the vehicle comprising speakers arranged in a plurality of locations in the vehicle;

sending an audio signal to the speakers one speaker at a time;

receiving audio signals received by the first and second microphones;

compiling binaural acoustic data for the vehicle based on the audio signals received by the first and second microphones;

receiving scan data from the laser device;

generating geometric data for the vehicle based on the scan data; and generating head-related transfer functions (HRTFs) for the object based on the binaural acoustic data and the geometric data for the vehicle.

4. The method of claim 3 further comprising:

compiling additional binaural acoustic data for the vehicle by placing the object in remaining seats of the vehicle;

sending the audio signal to the speakers one speaker at a time while the object is placed in each of the remaining seats of the vehicle; and receiving the audio signals received by the first and second microphones while the object is placed in each of the remaining seats of the vehicle.

5. The method of claim 4 further comprising generating additional geometric data for the vehicle with the object placed in each of the remaining seats of the vehicle.

6. The method of claim 5 further comprising generating the HRTFs for the object based on the additional binaural acoustic data and the additional geometric data for the vehicle.

7. The method of claim 3 further comprising generating additional HRTFs for the object by placing the object in each seat of additional vehicles.

8. The method of claim 7 further comprising:

dividing the binaural acoustic data of the vehicle and additional binaural acoustic data collected from the additional vehicles into a first component associated with the object and a second component associate with the vehicle and the additional vehicles;

decoupling the HRTFs and the additional HRTFs from the first component; and indexing the HRTFs and the additional HRTFs to the geometric data of the vehicle and the additional geometric data of the additional vehicles.

* * * * *